United States Patent [19]

Lombardi et al.

[11] Patent Number: 4,893,719

[45] Date of Patent: Jan. 16, 1990

[54] COMPARTMENTALIZED SEPARATING CONTAINER

[75] Inventors: John J. Lombardi, Marlton; Michael Handline, Williamstown, both of N.J.; Gary Goode, Davie, Fla.

[73] Assignee: T and C Associates, Williamstown, N.J.

[21] Appl. No.: 217,164

[22] Filed: Jul. 11, 1988

[51] Int. Cl.[4] ..... B65D 21/02

[52] U.S. Cl. ..... 220/1 T; 220/22; 220/23.4

[58] Field of Search ..... 220/1 T, 22, 23.4

[56] References Cited

U.S. PATENT DOCUMENTS

| | | | |
|---|---|---|---|
| 1,236,376 | 8/1917 | McGill | 220/404 |
| 1,606,068 | 11/1926 | Firth | 220/19 |
| 2,736,454 | 2/1956 | McConnell | 220/20 |
| 2,855,210 | 10/1958 | Joyce | 280/47.19 |
| 3,047,185 | 8/1962 | Lewis | 220/18 |
| 3,172,346 | 3/1965 | Siskind et al. | 95/98 |
| 3,280,988 | 10/1966 | Bennett | 211/71 |
| 3,402,848 | 9/1968 | Busey | 220/63 |
| 3,460,850 | 8/1969 | Franklin | 280/47.2 |
| 3,591,194 | 8/1971 | Vega | 280/47.26 |
| 3,856,173 | 12/1974 | Deane et al. | 220/1 T |
| 3,893,615 | 7/1975 | Johnson | 232/43.2 |
| 4,017,092 | 4/1977 | Boomer | 280/47.26 |
| 4,066,156 | 1/1978 | Basile | 190/18 A |
| 4,108,609 | 8/1978 | Petzinger | 23/259.1 |
| 4,316,615 | 2/1986 | Willette | 280/47.26 |
| 4,550,931 | 11/1985 | Ziaylek, Jr. | 280/655 |
| 4,739,894 | 4/1988 | Pender | 220/1 T |

FOREIGN PATENT DOCUMENTS

| | | |
|---|---|---|
| 3332742 | 3/1985 | Fed. Rep. of Germany . |
| 8300820 | 6/1983 | Netherlands . |
| 1533841 | 1/1979 | United Kingdom . |

*Primary Examiner*—A. Michael Chambers
*Attorney, Agent, or Firm*—Thomas A. Lennox

[57] ABSTRACT

A compartmentalized trash container separable into three separate containers to receive recyclable trash includes three rectangular separate containers which nest together to form a rectangular shaped combination with a rectangular frame to interfit over the top edge and hold the nested containers together with a hingeable cover attached to the frame to open and close access to all of the separate containers.

31 Claims, 2 Drawing Sheets

28
30
3
18
10
3
14
12
30
36
24
26
28
32
34
18
22
20

42
16
50
44
46
40
38
50
50
38
14
12

COMPARTMENTALIZED SEPARATING CONTAINER

BACKGROUND OF THE INVENTION

This invention involves a compartmentalized separating container to aid in the separating of and the separate disposal of the segregated material. Specifically, this inventions involves a compartmentalized trash container to allow separation of different types of trash and segregate recyclable materials to be disposed of separately.

There have long been compartmentalized containers to separate various items. There have been containers which allow for the disposal of separate containers generally taking the shape of a nest of containers inside a large container. In these devices, the individual containers rest on a base bottom of a frame or encompassing container and are held in position either with a frame member toward the top of the container or the sides of the encompassing container.

More recently, there has been a more concerted effort to separate trash in the home requiring that the home owner separate glass containers and metal cans from the rest of the trash and garbage. The municipalities have provided containers, generally in the form of buckets, into which the cans and glass can be placed at the curb for pick up by the sanitation department. This added burden on the home owner has required either separate trash cans in the kitchen area or, in the alternative, required the person throwing away a bottle, jar or can, to walk outside and deposit that item in the appropriate container in the garage or outside with the large trash containers. If the homeowner accidently places the can or bottle in with the bulk trash, he or she is subject to a fine under municipal, county or state ordinances/statutes. Most persons do not desire to have two or three trash cans in the kitchen area and a compartmentalized integral unit will allow separation, but makes disposal of the separated trash into the larger trash cans going to the curb, most difficult. Further, nested containers in some type of master container to keep them in a single unit, are bulky, heavy, unwieldy and difficult to keep clean. There is clearly a need for an effective trash container which will be unobtrusive in character and yet effectively allow separation and disposal of the trash from the kitchen. None of the prior art devices satisfy these needs nor attain the objects described hereinbelow.

SUMMARY OF THE INVENTION

It is an object of this invention to provide a compartmentalized container that allows separation of different types of material and yet allows the segregated material to be disposed of separately.

It is an additional object of the present invention to provide a compartmentalized trash container to allow separation of different types of trash, in particular, recyclable trash and to allow the segregated trash to be disposed into separate larger containers for disposal by sanitary workers.

It is a particular object of the present invention to provide a compartmentalized container wherein the individual compartments are separable and yet held together by a device that does not significantly add to the bulk of the container and specifically avoids the use of a large container into which the separable containers interfit.

It is an additional object of the present invention to provide a plurality of nestable containers which are held together with a frame of minimal bulk wherein the frame is the only device holding the nestable containers together.

It is a particular object of the present invention to provide a plurality of nestable containers which are securely held together in the nested shape and yet are easily separated for individual disposal.

It is a particular object of the present invention to provide a compartmentalized container including a plurality of nested containers which are held together by a single frame and are easily moved, while in the nested condition and yet are easily separable into the separate individual containers.

It is further object of the present invention to provide a compartmentalized container separable into individual nested containers, but having a top closure which allows easy opening and closing of the top to reach any of the individual nested containers.

It is a specific object of the present invention to provide a compartmentalized container including a plurality of individual nested containers held together with a frame with a top closure hingeably attached to the frame so that opening the disattachment closure opens all of the separated containers.

The invention is a compartmentalized container to allow separation of different types of material and allow the segregated material to be disposed of separately. The compartmentalized container includes at least two separate containers, each container including an open, generally unobstructed top, vertical side walls, each terminating at an upper edge, a closed bottom, and a sufficient size and shape that the containers are nestable together so that the upper edges not abutting another upper edge form a peripheral shape of an outer edge shape. The device also includes a frame means to interfit over the outer edge shape holding the nested containers together and a top cover means to integrally cover the combined nested tops of the containers. The device further includes hinge means to hingeably attach the top cover means to the device to allow the top cover means to hingeably uncover and cover the combined tops of the nested containers.

A preferred invention is a compartmentalized container to allow separation of different types of material and allow the segregated material to be disposed of separately. The compartmentalized container includes at least two separate containers, each container including an open, generally unobstructed top, vertical side walls, each terminating at an upper edge, a closed bottom, and a sufficient size and shape that the containers are nestable together to form a rectangular shape of outer edges, being combined upper edges of nested containers not in abutment with another upper edge. The compartmentalized container further includes a frame means of a rectangular shape and size sufficient to interfit over the outer edges holding the nested containers together, and a top cover means attached to the frame means to cover the tops of the containers. The compartmentalized container further includes hinge means to hingeably attach the cover means to the frame means to allow it to hingeably uncover and cover the tops of the containers.

It is preferred that each of the containers have a rectangular shaped upper edge, and further that the container upper edges have lengths longer than widths and the shape of each is such that when two containers are nested lengthwise and a third container is nested lengthwise abutting combined edge widths of the two containers the rectangular outer edge is formed. It is preferred that the outer edges nested form be a square, and that a cover means includes a single cover panel of sufficient size and shape to close all the container tops. It is further preferred that there be three containers having rectangular shaped upper edges with lengths longer than widths and the nested containers together form the outer edges in the shape of a square. It is further preferred that the frame means be the only means holding the nested containers together. It is further preferred that there be no outer container into which the containers nest. It is particularly advantageous not to utilize a master container surrounding and containing the separate containers nested together. A master container not only adds bulk but also provides another container to receive inadvertent overflow of liquids or garbage requiring extra cleaning and handling.

A preferred embodiment is a compartmentalized trash container to allow separation of different types of trash and allow the segregated trash to be disposed of separately. The trash container includes three separate containers, each container including an open, generally unobstructed top, four vertical side walls, each terminating at an upper edge that together form a rectangular shaped container upper edge with lengths longer than widths, a closed bottom, and a sufficient size and shape that the trash containers are nestable together to form a square shape of combined upper edges, being outer edges not in abutment with another upper edge. The trash container further includes a frame means of a square shape and size to interfit over the outer edges holding the nested containers together, wherein there are no outer containers into which the containers nest. It is particularly preferred that the frame means be only means holding the nested containers together and that two containers are nested lengthwise and the third containers is nested lengthwise abutting combined edge width of the two containers. A preferred compartmentalized trash container includes at least two separate containers, each container including an open, generally unobstructed top, four vertical side walls, each terminating at an upper edge that together form a rectangular shape upper edge, a closed bottom, and a sufficient size and shape that the trash containers are nestable together to form a rectangular shape of combined upper edges, being outer edges not in abutment with another upper edge.

DESCRIPTION OF PREFERRED EMBODIMENTS

Figures 1, 2:
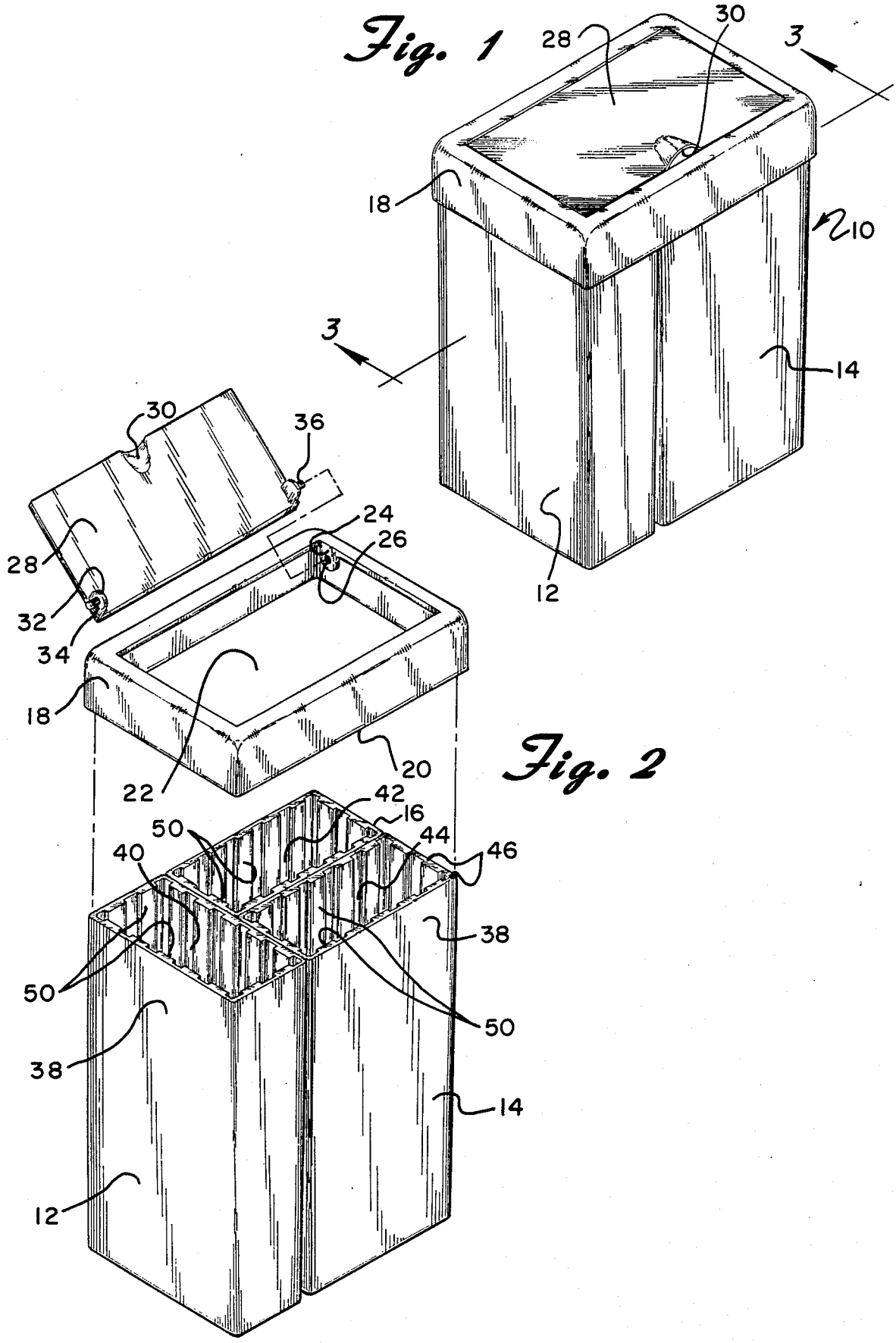
FIG. 1 is a perspective view of the compartmentalized container of the present invention with the individual containers nested together, held in position by the frame to which the hinged closure is attached.
FIG. 2 is an exploded perspective view of the container illustrated in FIG. 1.
Figure 3:
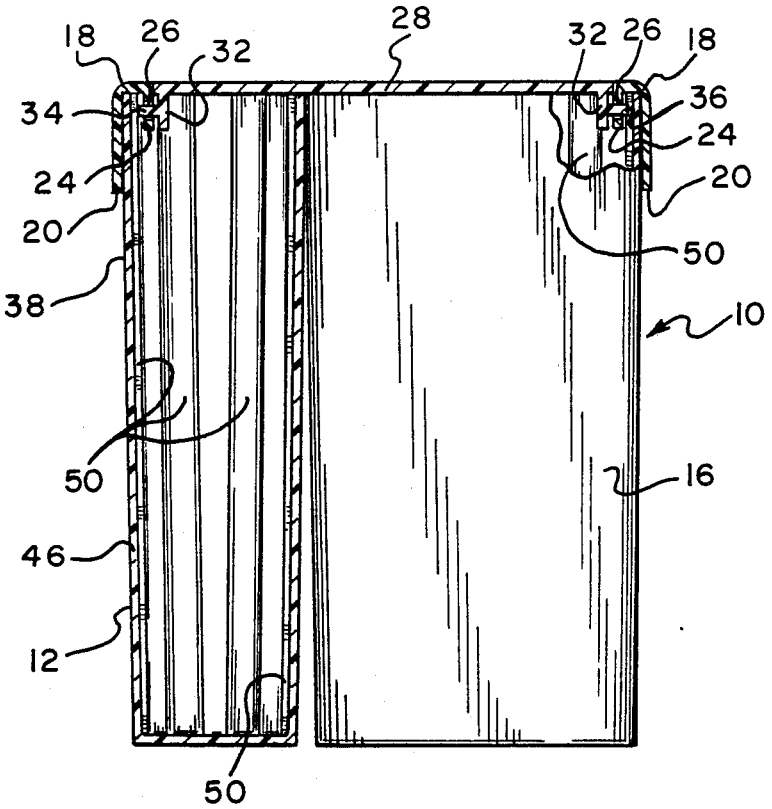
FIG. 3 is cross-sectional view taken along line 3—3 of FIG. 1.
Figure 4:
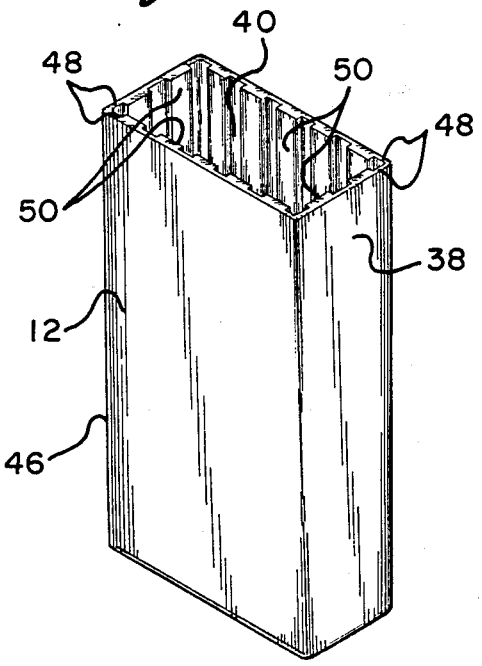
FIG. 4 is a perspective view of an individual separable container which when nested together with the other separable containers form the container illustrated in FIGS. 1 through 3.
Figure 5:
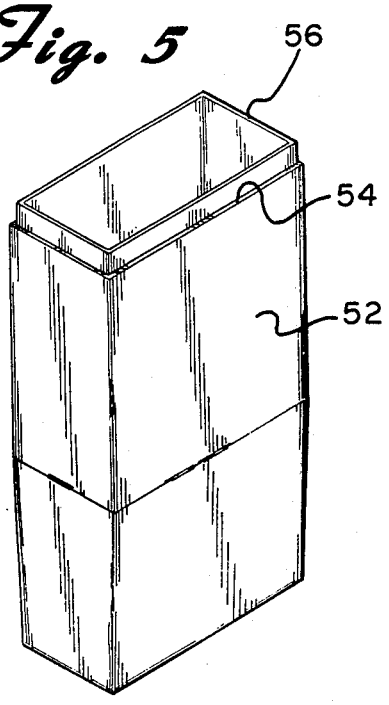
FIG. 5 is a second embodiment of the invention in the form of a perspective view of a separable container which when nested together forms a compartmentalized container similar to that illustrated in FIGS. 1 through 3.

In FIGS. 1 and compartmentalized container 10, in the form of a trash container for use in the kitchen is molded of a semi-rigid to rigid plastic polymer, like polyolefin, such as polyethylene, polypropylene, or like polymers. Container 10 includes three separate containers 12, 14, and 16 all nested together and held in position with frame 18 which has a lower depending peripheral edge 20 extending over the outer-upper edges of the nested containers to hold them in place. Top cover 28 hingeably attaches to frame 18 and is liftable by raised handle edge 30 to open essentially the entire tops of the separate containers. As illustrated in FIG. 2, rectangular opening 22 of frame 18 opens to the top openings, 40, 42 and 44 of the separate containers. Frame depending edge 20 interfits over outside edges 46 which are the upper edges of the separate nested containers that are not in abutment with other top edges of the containers. Depending tab appendages 24 are connected to and extend downwardly from the inside edge of frame 18. There is an identical appendage 24 on the opposite corner along the lengthwise edge hidden in this view. Holes 26 receives horizontal hinge pins 34 and 36 which extend from downwardly depending members 32 which extend from both ends of top cover 28. Since the polymer plastic is ductile, the frame is easily pulled so that pins 34 and 36 interfit and snap into holes 26 to provide the hinge connection. Containers 12, 14 and 16 are held together by frame 18 which holds the containers only at their upper portions 38. As illustrated, there is a substantial draft for the containers at their lower portions, but there is a minimal draft at the upper portions 38. In FIG. 3, the cross sectional view opens the interior of separate container 12 to illustrate the interfitting of pin 34 through hole 26 in downwardly depending tab 24 to provide the hingeable attachment between cover 28 and frame 18. In FIG. 4, individual container 12 is illustrated showing that upper edges 48 of the container are shaped to snugly nest with the other containers. Vertical ribs 50 provide additional rigidity with minimal weight for the container. The thickness of the walls are not drawn to scale, they being in the range of 0.060 to 0.120 inch. In FIG. 5, container 52 is an alternative embodiment which employs shoulder 54 which is proximate and just below upper edge 56. In this embodiment, shoulder 54 provides a resting place for the frame and increases the rigidity of the top of container 52. In this embodiment, the vertical ribs are not necessary.

The shape of the individual containers may vary greatly as well as the nested shape of the multiple containers. For example, there may be two containers of rectangular shape that are nested side by side or end to end. There may also be three rectangular containers with are nested side by side to form a rectangular nested shape. There may be two or more square containers and a particularly effective shape would be four nested square containers to form a square shape. Another embodiment is a rectangular separate container coupled with two smaller square containers which will nest together to form a rectangle or a square. It is also possible to have separate containers that are triangular in shape which are nested together to form rectangles or even squares. It is also feasible to combine rectangular shapes and triangular shapes to form a rectangular combination as long as two triangular shapes are utilized in combination. It further possible to combine various other polygons which nest together to form rectangular nested shapes. The shapes may also have curved sides and may be partial circles or partial oblate shapes. In that embodiment, the straight sides could nest together to form a circular or oblate nested shape. The configuration of the top cover and the hingeable attachment may be accomplished in a variety of ways and preferably is constructed of a lifetime hinge molded directly between the frame and the top cover so that the combination is an integral unit. In this embodiment, the top cover does not require the depending members and the horizontal pins and the frame does not require the depending member with the holes. The edge of the cover opposite the handle is a molded lifetime hinge directly attached to the interior edge of the frame.

While this invention has been described with reference to the specific embodiments disclosed herein, it is not confined to the details set forth and the patent is intended to include modifications and changes which may come within and extend from the following claims.

We claim:

1. A compartmentalized container to allow separation of different types of material and allow the segregated material to be disposed of separately, the compartmentalized container comprising:

(a) at least two separate containers, each container comprising:
  (i) an open, generally unobstructed top,
  (ii) vertical side walls, each terminating at an upper edge,
  (iii) a closed bottom, and
  (iv) a sufficient size and shape that the containers are nestable together so that the upper edges not abutting another upper edge form a periferial shape of an outer edge shape,
(b) an integral frame member coextensive with the outer edge shape comprising a depending edge over the outer edge shape sized to hold the nested containers together,
(c) a top cover means to integrally cover the combined nested tops of the containers, and
(d) hinge means to hingeably attach the top cover means to the device to allow the top cover means to hingeably uncover and cover the combined tops of the nested containers.

2. The compartmentalized container of claim 1 wherein the outer edge shape is a rectangular shape.

3. The compartmentalized container of claim 2 wherein each of the containers has rectangular shaped upper edge.

4. The compartmentalized container of claim 1 wherein the top cover means is hingeably attached to the frame member.

5. The compartmentalized container of claim 1 wherein each of the containers has rectangular shaped upper edge with lengths longer than widths and the shape of each is such that when two containers are nested lengthwise and a third container is nested lengthwise abutting combined edge widths of the two containers forming a rectangular outer edge shape.

6. The compartmentalized container of claim 1 wherein the outer edge shape nested form is a square.

7. The compartmentalized container of claim 1 wherein the top cover means comprises a single cover panel of sufficient size and shape to close all the container tops.

8. The compartmentalized container of claim 1 wherein there are three containers.

9. The compartmentalized container of claim 1 wherein the each of the containers have rectangular shaped upper edges with lengths longer than widths and the nested containers together form the outer shape of a square.

10. The compartmentalized container of claim 1 wherein the frame member is the only means holding the nested containers together.

11. The compartmentalized container of claim 1 wherein there is no outer container into which the containers nest.

12. The compartmentalized container of claim 11 wherein the frame member is the only means holding the nested containers together.

13. A compartmentalized container to allow separation of different types of material and allow the segregated material to be disposed of separately, the compartmentalized container comprising:

(a) at least two separate containers, each container comprising:
  (i) an open, generally unobstructed top,
  (ii) vertical side walls, each terminating at an upper edge,
  (iii) a closed bottom, and
  (iv) a sufficient size and shape that the containers are nestable together so that the upper edges not abutting another upper edge form a rectangular periferial shape of an outer edge shape,
(b) an integral frame member coextensive with the outer edge shape comprising a depending edge over the outer edge shape sized to hold the nested containers together,
(c) a top cover means attached to the frame member to cover the combined tops of the container, and
(d) hinge means to hingeably attach the cover means to the frame member to allow the top cover means to hingeably uncover and cover the nested tops of the containers.

14. The compartmentalized container of claim 13 wherein each of the containers has rectangular shaped upper edge.

15. The compartmentalized container of claim 13 wherein each of the containers has rectangular shaped upper edge with lengths longer than widths and the shape of each is such that when two containers are nested lengthwise and a third container is nested lengthwise abutting combined edge widths of the two containers, the rectangular outer edge shape is formed.

16. The compartmentalized container of claim 13 wherein the outer edges nested form is a square.

17. The compartmentalized container of claim 13 wherein there are three containers.

18. The compartmentalized container of claim 13 wherein the each of the containers have rectangular shaped upper edges with lengths longer than widths and the nested containers together form the outer edges in the shape of a square.

19. The compartmentalized container of claim 13 wherein the frame member is the only means holding the nested containers together.

20. The compartmentalized container of claim 13 wherein there are no outer containers into which the containers nest.

21. The compartmentalized container of claim 20 wherein the frame member is the only means holding the nested containers together.

22. A compartmentalized trash container to allow separation of different types of trash and allow the segregated trash to be disposed of separately, the trash container comprising:

(a) three separate containers, each container comprising:

(i) an open, generally unobstructed top, (ii) four vertical side walls, each terminating at an upper edge that together form a rectangular shaped container upper edge with lengths longer than widths, (iii) a closed bottom, and (iv) a sufficient size and shape that the trash containers are nestable together to form a rectangular shape of combined upper edges, the rectangular shape being outer edges not abutting another upper edge, (b) an integral rectangular shaped frame member coextensive with the outer edge shape comprising a depending edge over the outer edges holding the nested containers together, wherein there are no outer containers into which the containers nest and no other means to hold the nested containers together, (c) a top cover means comprising a single cover panel attached to the frame member to cover over the combined tops of the nested containers, and (d) hinge means to hingeably attach the cover means to the frame member to allow it to hingeably uncover and cover the tops of the containers.

23. The trash container of claim 22 wherein two containers are nested lengthwise and the third container is nested lengthwise abutting combined edge widths of the two containers.

24. A compartmentalized trash container to allow separation of different types of trash and allow the segregated trash to be disposed of separately, the trash container comprising:

(a) at least two separate containers, each container comprising:

(i) an open, generally unobstructed top, (ii) four vertical side walls, each terminating at an upper edge that together form a rectangular shaped upper edge, (iii) a closed bottom, and (iv) a sufficient size and shape that the trash containers are nestable together to form a rectangular shape of combined upper edges, being outer edges not abutting another upper edge, (b) an integral frame member coextensive with the outer edge shape comprising a depending edge over the outer edge shape sized to hold the nested containers together, (c) a top cover means attached to the frame member to cover the tops of the containers, and (d) hinge means to hingeably attach the cover means to the frame meber to allow it to hingeably uncover and cover the tops of the containers.

25. The trash container of claim 24 wherein each of the containers has rectangular shaped upper edges with lengths longer than widths and the shape of each is such that when two containers are nested lengthwise and a third container is nested lengthwise abutting combined edge widths of the two containers the rectangular outer edge is formed.

26. The trash container of claim 24 wherein the outer edges nested form is a square.

27. The trash container of claim 24 wherein the cover means comprises a single cover panel of sufficient size and shape to close all the container tops.

28. The trash container of claim 24 wherein there are three containers.

29. The trash container of claim 24 wherein the each of the containers have rectangular shaped upper edges with lengths longer than widths and the nested containers together form the outer edges in the shape of a square.

30. The trash container of claim 24 wherein the frame member is the only means holding the nested containers together.

31. The trash container of claim 24 wherein there are no outer containers into which the containers nest.

* * * * *